US005222605A

United States Patent [19]

Pogue

[11] Patent Number: 5,222,605

[45] Date of Patent: Jun. 29, 1993

[54] AUTOMATIC PARTICLE SIZE ANALYZER USING STACKED SIEVES

[75] Inventor: Glenn J. Pogue, Cincinnati, Ohio

[73] Assignee: Rotex, Inc., Cincinnati, Ohio

[21] Appl. No.: 818,048

[22] Filed: Jan. 8, 1992

[51] Int. Cl.[5] ..... B07B 13/00

[52] U.S. Cl. ..... 209/239; 209/260; 209/315; 209/317; 209/390

[58] Field of Search ..... 209/239, 237, 260, 315, 209/317, 386, 389, 390, 257, 247-250

[56] References Cited

U.S. PATENT DOCUMENTS

| | | | |
|---|---|---|---|
| 2,773,599 | 12/1956 | Litus et al. | 209/386 |
| 3,098,037 | 7/1963 | Tonjes et al. . | |
| 3,439,800 | 4/1969 | Tonjes . | |
| 4,487,323 | 12/1984 | Marrs . | |
| 5,059,310 | 10/1991 | Fisher et al. | 209/237 |

OTHER PUBLICATIONS

Seishin I-Robot Sifter RPS-85-Seishin Enterprise Co., Ltd.

Seishin II-Robot Sifter RPS-85EX-Seishin Enterprise Co., Ltd.

Tyler I-Operation, Maintenance and Parts Manual-Ro-Tap Testing Sieve Shaker-W. S. Tyler, Inc.

Tyler II-Specification Tables For Industrial Wire Cloth and Woven Wire Screens-Cat. No. 74, 1981 Ed., W. S. Tyler, Inc.

*Primary Examiner*—H. Grant Skaggs

*Attorney, Agent, or Firm*—Wood, Herron & Evans

[57] ABSTRACT

The size ranges of particles separated on a stack of sieves of different mesh sizes is measured automatically. The stack is clamped together and shaken as a unit to separate the respective fractions, following which the sieves are sequentially separated from the stack and inverted one at a time to dump the fraction retained on each, onto a scale. Each fraction is weighed separately and their relative proportions can be calculated automatically. In a preferred embodiment the sieves are individually cantilevered from a vertical conveyor. The sieves are inverted one by one to dump their contents by advancing them around a horizontal roll at a lower end of the conveyor.

49 Claims, 8 Drawing Sheets

AUTOMATIC PARTICLE SIZE ANALYZER USING STACKED SIEVES

FIELD OF THE INVENTION

This invention relates to an apparatus and method for automatically measuring the weights and/or relative proportions of the size ranges of particles in particulate mixtures.

BACKGROUND OF THE INVENTION

Particle size analyses, that is, measurements of the relative proportions by weight of particles of a given sample in different size (diameter) ranges, are widely used in process control and optimization. The size range of a given fraction may be characterized, for example, as being between 0.01 and 0.05 inch, which means that the particles in that range are retained on a screen having openings smaller than 0.01 inch but pass through a sieve having openings larger than 0.05 inch. Such analyses are frequently performed with sieves (screens) of progressively finer mesh sizes, such as the well-known U.S. Standard testing sieves. The sample to be analyzed is placed on the coarsest sieve at the top of a stack of sieves and the entire stack is shaken, particles of different size ranges being retained on different sieves. The sieves are then removed one by one from the stack and the fractions on them are emptied onto a scale and weighed to determine the proportion of the fraction relative to the total sample weight. If the analysis is carried out manually, as is often done, the procedure is slow and labor intensive. A mechanical shaking device such as the "Ro-tap" shaker made by W.S. Tyler, Inc., of Mentor, Ohio, can be used to apply standardized shaking schedules to the stack of sieves, but nevertheless each sieve must be taken manually from the stack, the retained fraction emptied from it and weighed, and the emptied sieves restacked in proper sequence for the next analysis.

In many laboratories and manufacturing processes it is necessary to make particle size range analyses frequently and routinely. It may, for example, be desirable to monitor the proportion of "fines" (particles below some predetermined minimum size), or the proportion of coarse "overs"; or the relative distribution among size ranges may be important for process control. Because manual particle size range analyses are time consuming, in those applications where they must be performed frequently and routinely there exists a need for an automatic particle size analyzer which will separate the various size range fractions, and empty and weigh them individually with no or minimal manual control and manipulation.

Any automatic particle size analysis using a graduated set of sieves necessarily requires separately weighing the particles retained on each sieve. Automatic apparatus for carrying out a separation, and weighing and calculating the fractions is known and is commercially available. The "Gradex" particle size analyzer, which is described in Marrs U.S. Pat. No. 4,487,323 and which is made and sold by the assignee of this application, is one such analyzer. In that apparatus the sample to be analyzed is fed into a horizontal polygonal drum having sieves of progressively coarser mesh sizes on its side faces. The drum is first indexed or positioned rotationally so that the finest sieve is at the bottom, and the sample to be analyzed is deposited on that sieve. The entire drum is shaken, so that particles finer than the mesh of the sieve pass through and fall onto a weigh pan and are weighed automatically by an electronic scale. The drum is then indexed rotationally so that the next finest sieve is at the bottom; the particles retained on the first sieve fall onto the second sieve. The drum is again shaken and the particle fraction which can pass through the second sieve is thereby separated. The process of drum indexing, shaking, and weighing is continued automatically until the sample has been screened on each sieve. The fraction weights may be totaled by a computer and their relative percentages determined and displayed in a readout.

The Gradex machine is expensive and comparatively slow by reason of the polygonal drum which must be indexed to and shaken at each rotational position. Moreover the analyses it provides do not always correlate directly with analyses made with a more conventional stack of standard screens. It has therefore been desirable to provide a machine which is comparatively simpler and faster, and which will provide accurate analyses using a standard stack of sieves rather than a polygonal drum, and which can be operated entirely automatically with virtually no operator attention.

SUMMARY OF THE INVENTION

Rather than a horizontal polygonal drum, the apparatus and method of this invention utilize a stack of sieves for making particle size analyses. The sample to be analyzed is introduced onto the topmost (coarsest) sieve of the stack and the entire stack is vibrated or shaken as a unit to separate the fractions retained on the respective sieves. At the bottom of the stack is a pan (which is referred to and treated herein as a "sieve" even though it is actually imperforate) which catches and holds the fines that have fallen through all the other sieves. The individual sieves are then automatically and sequentially removed from the stack and emptied onto a weighing apparatus which sequentially records the weight of each fraction, from which the weight percentage proportions of the respective fractions can be calculated. In a preferred embodiment, each sieve of the stack is separately mounted or cantilevered from a conveyor having a vertically oriented section or run and is movable around a horizontal bottom roll below the vertical run. The conveyor is advanced or indexed downwardly to move the sieves downwardly to swing the sieves sequentially around the bottom roll. Each sieve is inverted by its movement around the bottom roll, and dumps the retained particles onto an electronic weigh scale. The diameter of the bottom roll is such that a sieve moving around the bottom roll is tipped sufficiently to dump the particles retained on it before particles are dumped from the next sieve. The sieves are thereby emptied individually, and the various fractions are weighed separately. After all the sieves have been emptied, the conveyor reverses to return the empty sieves back around the roll, where they are again aligned as a stack to receive and analyze a subsequent sample. The entire operation is automatic.

To insure complete emptying of each fraction from its sieve before weighing, the apparatus optionally but preferably includes an automatic sieve cleaner. The cleaner engages each sieve while it is inverted over the weighing pan, after most of the particles have fallen from it. The cleaner operates a brush or other cleaning device whereby remaining adherent particles are dislodged and emptied from the sieve for weighing with the rest of the fraction separated on it.

Because the sieves are cantilever-mounted, they tend to tip or sag under gravity on the vertical run and thereby become cocked or disaligned with one another. This would prevent accurate fraction separation. The invention includes optional but preferred means for automatically temporarily clamping the sieves together, in alignment on a vertical axis, for shaking. The clamping means is released after shaking so that the sieves can be individually moved around the bottom roll.

It is an advantage of the apparatus of the invention that it can utilize U.S. Standard, Tyler, or other sieves, in their pre-existing sizes and configurations. Many users are accustomed by long practice to performing particle size analyses on U.S. Standard or Tyler screens; frequently, production parameters are specified in size ranges as determined by such analyses. An analysis performed on a different type of analyzer, no matter however accurate, does not usually correlate identically with an analysis made with standard screens. In this invention, standard stacking sieves can be used in the apparatus to make the separations. Close correlation of an analysis provided by this invention with pre-existing stack screen analyses is thereby achieved.

DESCRIPTION OF THE DRAWINGS

The invention can best be further described by reference to the accompanying drawings in which.

DETAILED DESCRIPTION

Figure 1:
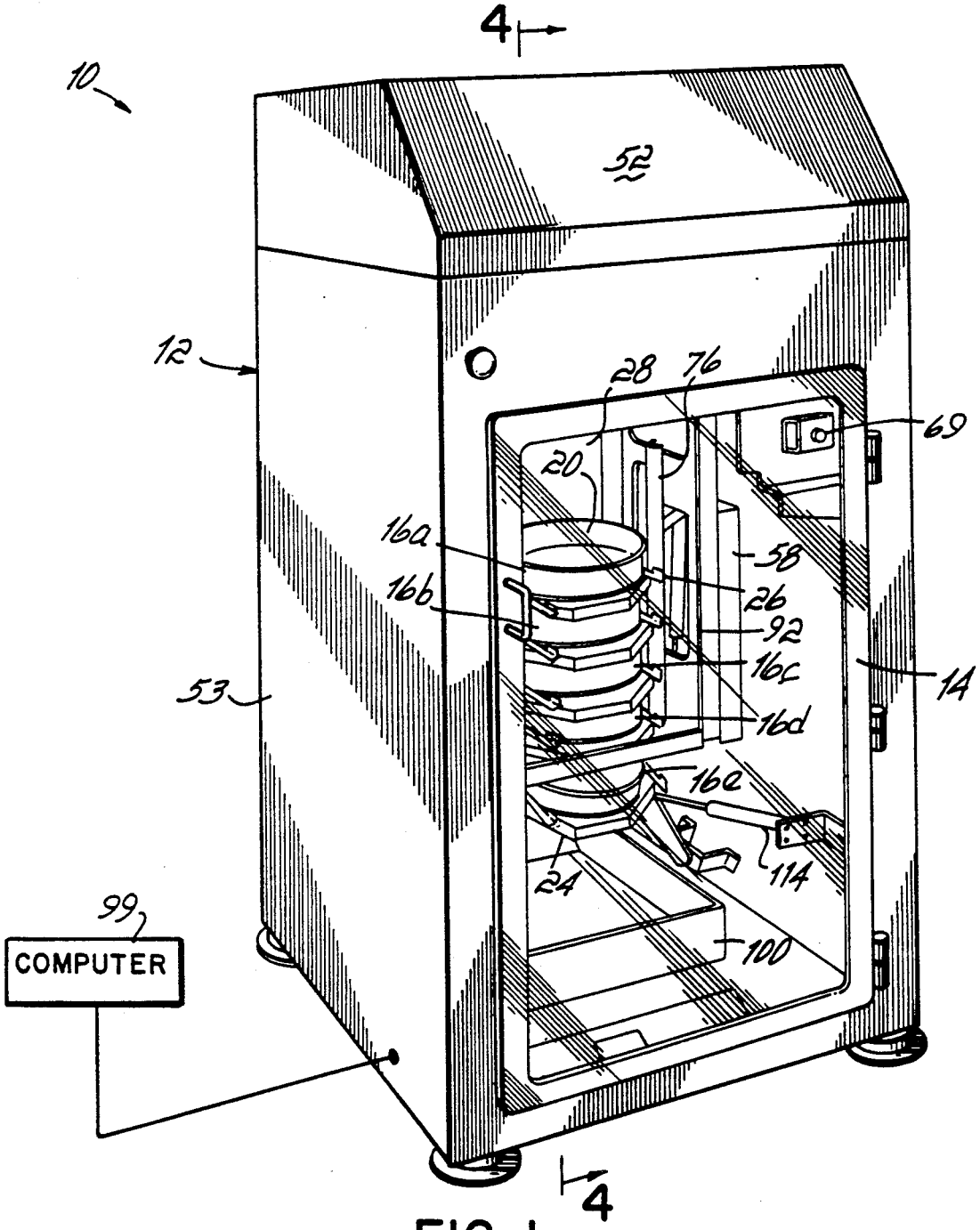
FIG. 1 is a perspective view, partly diagrammatic, of an automatic particle size analyzer in accordance with a preferred embodiment of the invention, showing the bottommost sieve of the stack being separated from the others as it swings around the bottom roll, thereby to dump the retained particles onto the weighing means.

The preferred embodiment of the automatic particle size analyzer 10 which is shown in the drawings is housed in a cabinet 12 having a hinged door 14. The apparatus utilizes a series or set of graduated sieves, seven in the embodiment shown, comprising sieves designated as 16*a, b, c, d, e,* and *f*, and an imperforate bottom pan 18 (see FIG. 7). Each sieve comprises a stackable cylindrical skirt 20 with axially spaced upper and lower peripheral flanges, and a screen or mesh 22 mounted inside skirt 20 (see FIGS. 2, 3 and 8). Typically, although not necessarily, the skirts are circular, about 8 inches in diameter and approximately 3 inches high, and may be conventional commercial screens. The skirts are of uniform diameter and the sieves may differ only in the size of the screens 22 which they mount. The respective sieves are progressively finer in the downward direction as viewed in FIG. 4, the topmost sieve 16*a* having the coarsest mesh. An application might for example utilize U.S. Standard testing sieves Nos. 30, 35, 40, 50, 70, and 120 as the sieves 16*a*–16*f*. The apparatus shown thus separates seven fractions (including the fines which are collected in bottom pan 18) which is sufficient for most analyses; if fewer fractions are needed, one or more sieves can be replaced with a dummy skirt having no sieve or a coarse sieve.

Figure 8:
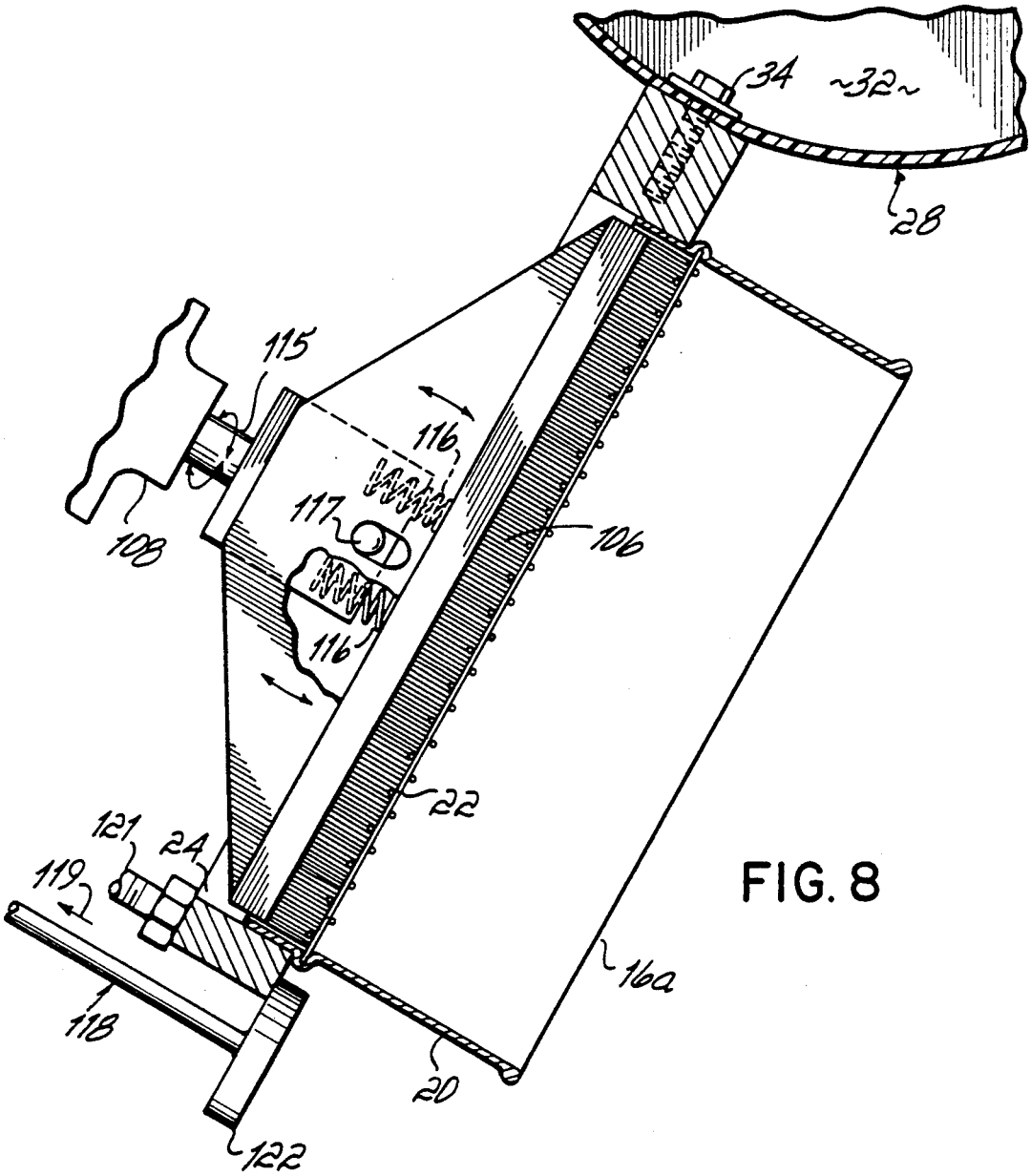
FIG. 8 is an enlarged fragmentary cross section of a sieve engaged by the cleaner.
Figure 9:
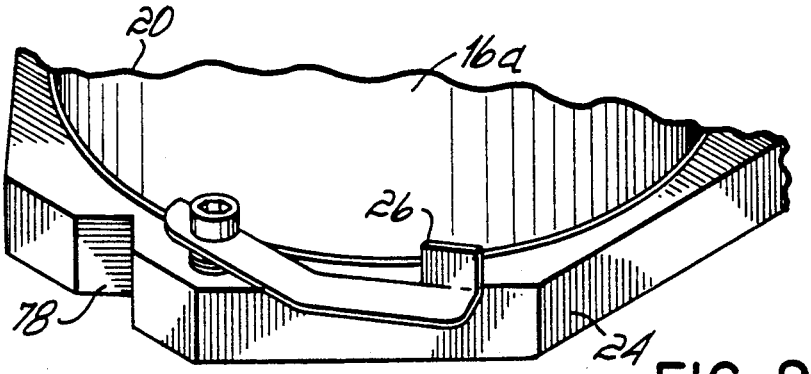
FIG. 9 is a perspective view, partly broken away, showing the means by which a sieve is secured to its holder.

Each sieve 16*a–f* and 18 is seated on and secured to a modular sieve holder or bracket 24 (see FIGS. 8 and 9). The bracket comprises a flat plate having a center opening which is sized to receive the lower portion of sieve skirt 22. Each sieve is removably secured in its holder 24, by a pair of swingable, spring loaded retainers 26, only one of which is shown.

Figure 3:
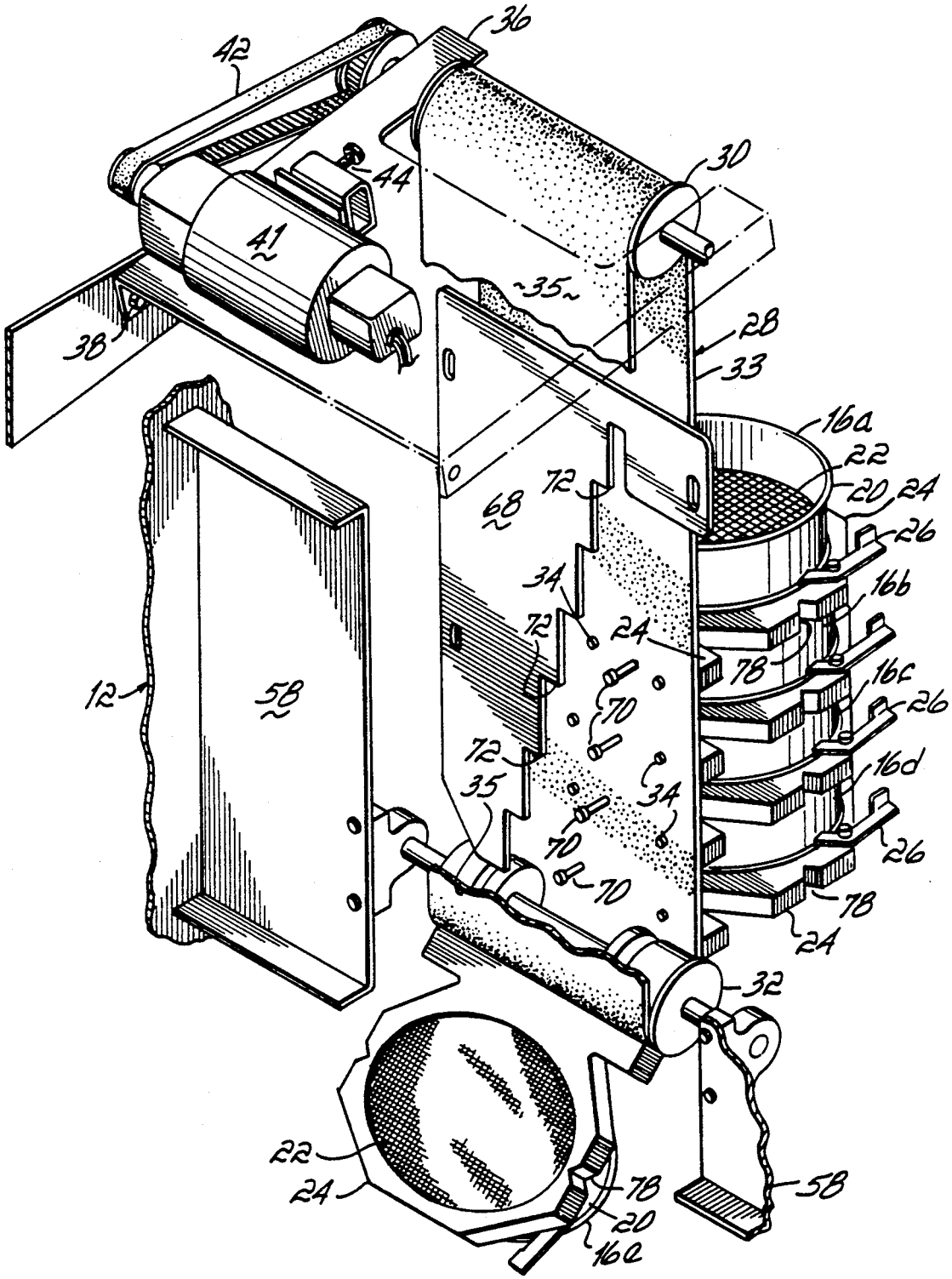
FIG. 3 is a perspective view generally similar to FIG. 2 but particularly showing the means by which the sieves are brought into alignment for shaking.

The holders 24 are cantilevered (mounted at one side only) to a conveyor 28 preferably in the form of a wide, endless belt as shown in FIG. 3 of the type ordinarily used for horizontal conveyors. Each sieve holder 24 is secured by one or more bolts 34 through the conveyor (see FIG. 8). Conveyor 28 passes around an upper roll 30 and a lower or bottom roll 32 (FIG. 3). The region traversed between upper roll 30 and lower roll 32 is referred to herein as vertical run 33. A back run 35 extends parallel to run 33 on the other side of the rolls. As will be explained, when all the holders are on the vertical run portion 33 of the conveyor, the sieves and holders are nestable to form a vertically aligned stack 31 (see FIG. 4) in which each sieve 16*b–f* and 18 seats against the bottom of the holder of a sieve above it. This stack can be shaken as a unit to make the separation; particles fall from one sieve directly into the next sieve below it and cannot escape laterally from the stack.

Lower roll 32 is mounted for rotation in journals secured to cabinet 12. Upper roll 30 is journaled on an upper roll support arm 36 which is pivoted to the cabinet 12 by pivot 38. Spring means 40, which may be a coil spring as shown or a selectively operable air spring, biases support arm 36 upwardly about pivot 36 to maintain tension on conveyor 28. Conveyor drive means in the form of an electric motor 41 with a speed reducer and brake is mounted on support arm 36 and is connected to turn upper roll 30 by a timing belt 42. Tension on belt 42 is maintained by an adjusting screw 44 (see FIG. 2).

Figure 4:
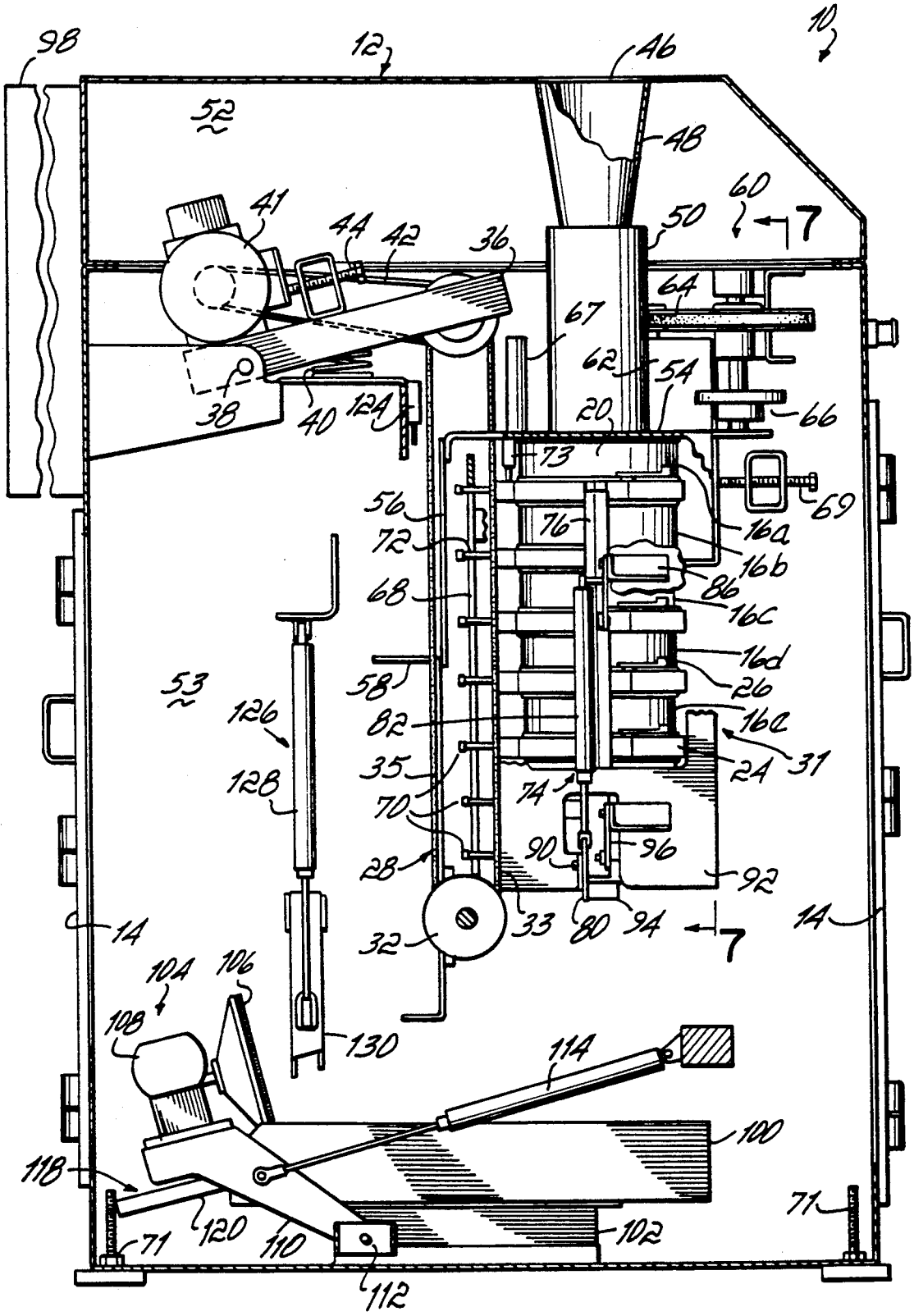
FIG. 4 is a vertical cross section of the apparatus, taken on line 4—4 of FIG. 1, and shows the stack of sieves in the starting position, ready to receive a sample to be analyzed.

Cabinet 12 includes a top portion 52 which can be removed from a lower portion 53 for access to the top of the operating mechanism. The sample to be analyzed is introduced through an opening 46 in top portion 52 and falls through a funnel 48 which in turn leads to a tubular chute 50 (FIG. 4). Funnel 48 separates from chute 50 if the cabinet top portion is removed. Chute 50 is mounted on a shaker top plate or mounting plate 54 which in turn is supported at one side by and on two parallel vertical leaf springs 56, 56 which project upwardly from bracket 58 in the cabinet. Leaf springs 56, 56, which may be resiliently flexible fiberglass strips, support top plate 54 and the sieves and other structure supported from it for vibration (FIG. 2).

The Shaking Means

Figure 2:
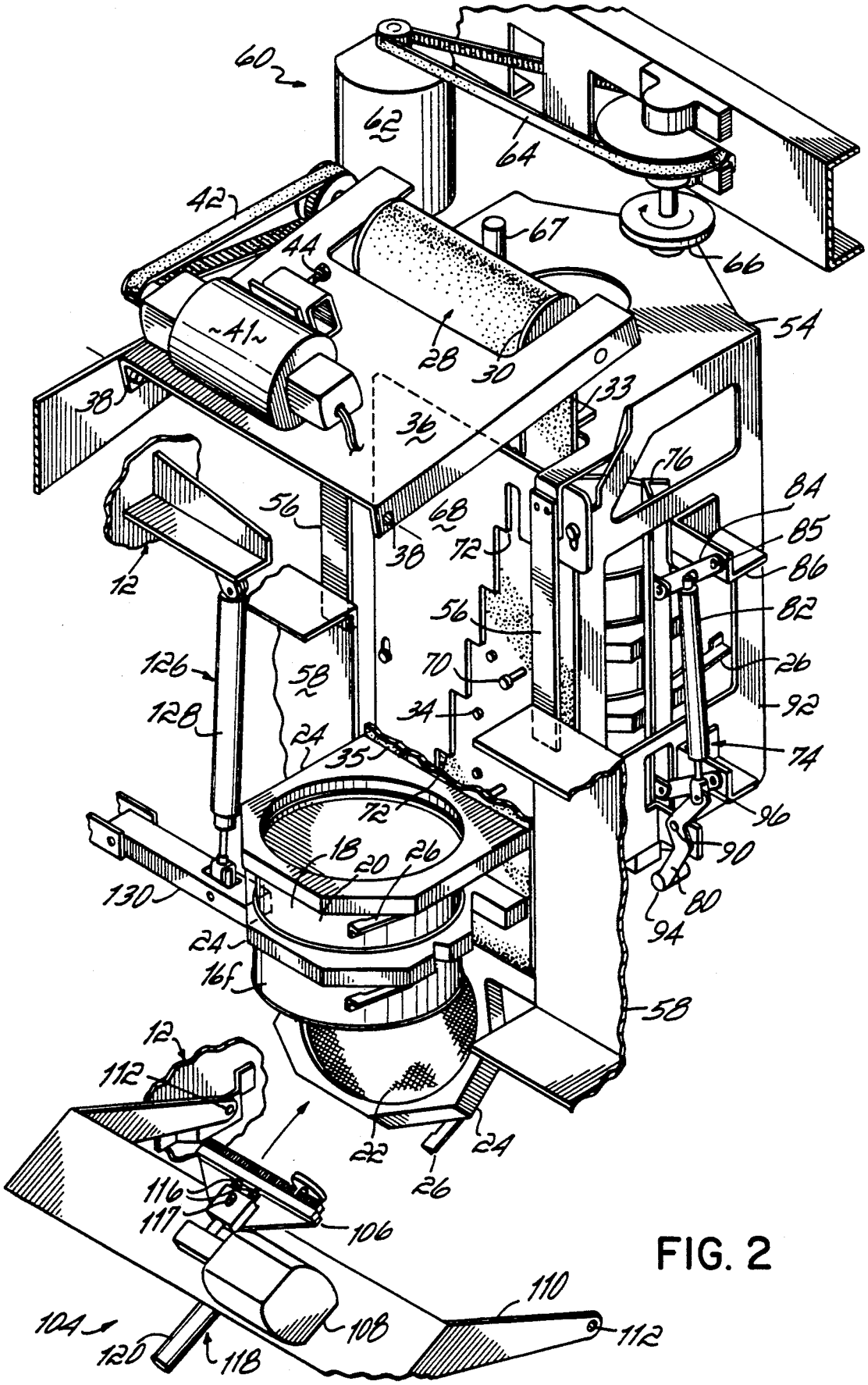
FIG. 2 is a diagrammatic perspective, partly broken away, of the conveyor operating mechanism of the analyzer, showing a sieve which has been inverted after passing around the bottom roll, preparatory to cleaning.
Figure 7:
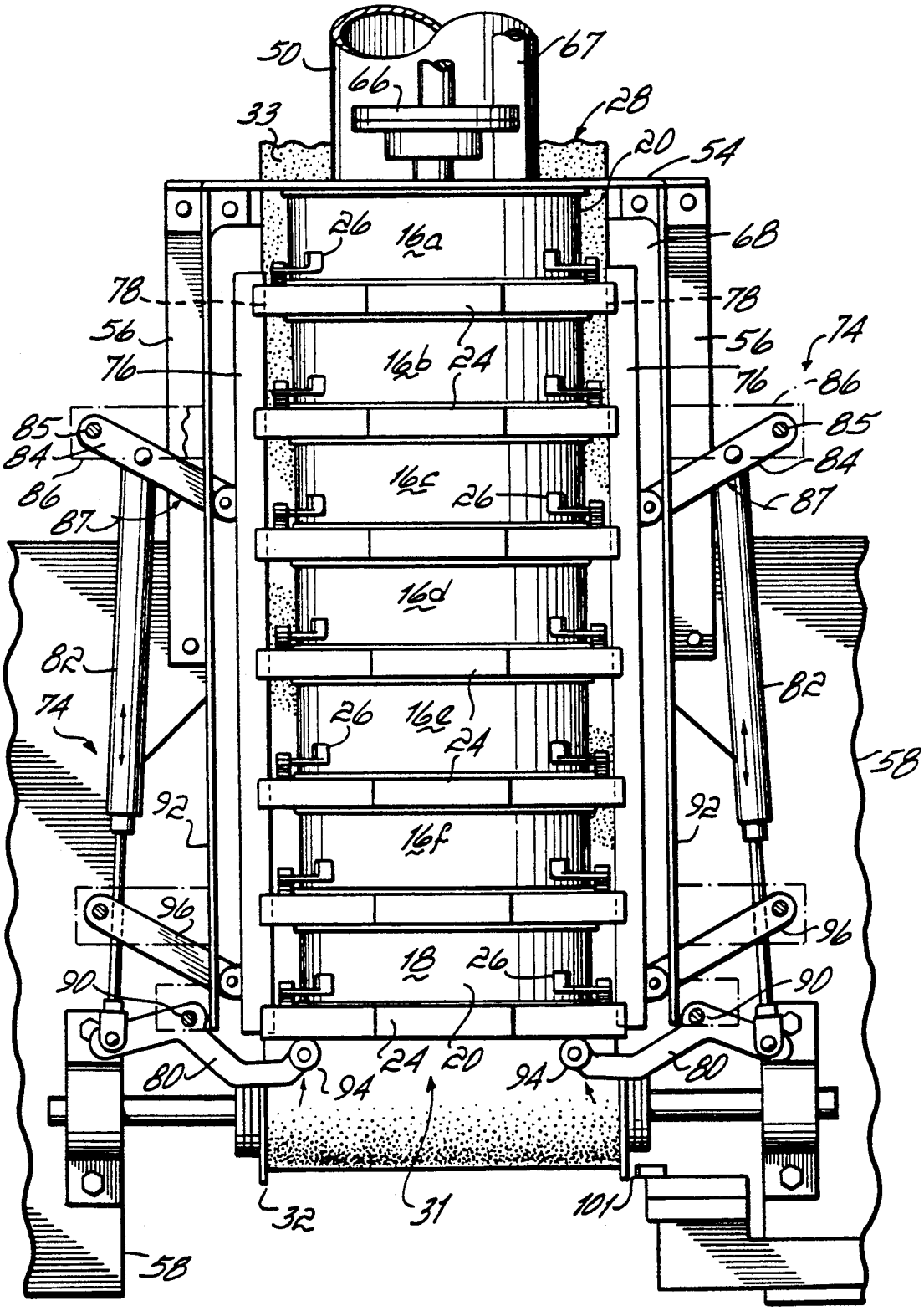
FIG. 7 is an enlarged partial vertical section taken on line 7—7 of FIG. 4.

Screening motion is imparted to the stack of sieves by drive means indicated generally by 60, see FIGS. 2, 4 and 7. In the embodiment shown drive means 60 includes a motor 62 on an adjustable bracket which in turn is mounted to the cabinet wall. A screw adjuster 69 bears between the bracket and the cabinet wall to tension the belt (FIG. 4). Motor 62 is connected by a timing belt 64 to turn an eccentric pin 66, which is journaled in and supports top plate 54 at the side thereof opposite leaf springs 56. Operation of motor 62 turns eccentric pin 66 in a circular orbit and thereby imparts a screening motion to plate 54 and the sieves suspended from it. The pin-engaging side of plate 54 (the right side as seen in FIG. 4) is moved in a circular orbit; the other side is constrained by the leaf springs 56, 56 to move in a more linear path. Eccentric pin 66 may, for example, move in an orbit of 1-3/16 inch diameter at a rate of 280 rpm, and thereby generate a lateral sieve acceleration of 1.3 g. Shaking cycle times in the range of 3 to 10 minutes are sufficient for many purposes.

The motion just described is preferred because it approximates that used in "Ro-tap" machines. However, it is pointed out that other screening motions may be used; the invention does not require the use of a particular gyratory, vibratory or other movement, provided the movement is sufficient to separate the particles on the various sieves. (The term "shaking" as used herein is meant to include all such types of screening movement, whether or not in the plane of the screen.) Optionally, a "tapper" or vertically reciprocating piston 67 (FIG. 4) may be mounted to top plate 54, to apply a repetitive "tapping" pulse or impact to the stack of sieves during shaking. The tapper is an air cylinder which is rapidly reciprocated to strike the plate, for instance at 200 cycles per minute. This assists in separating the particles and further simulates the tapping movement that is applied in mechanical shakers.

The Stack Leveling and Clamping Means

Figure 5:
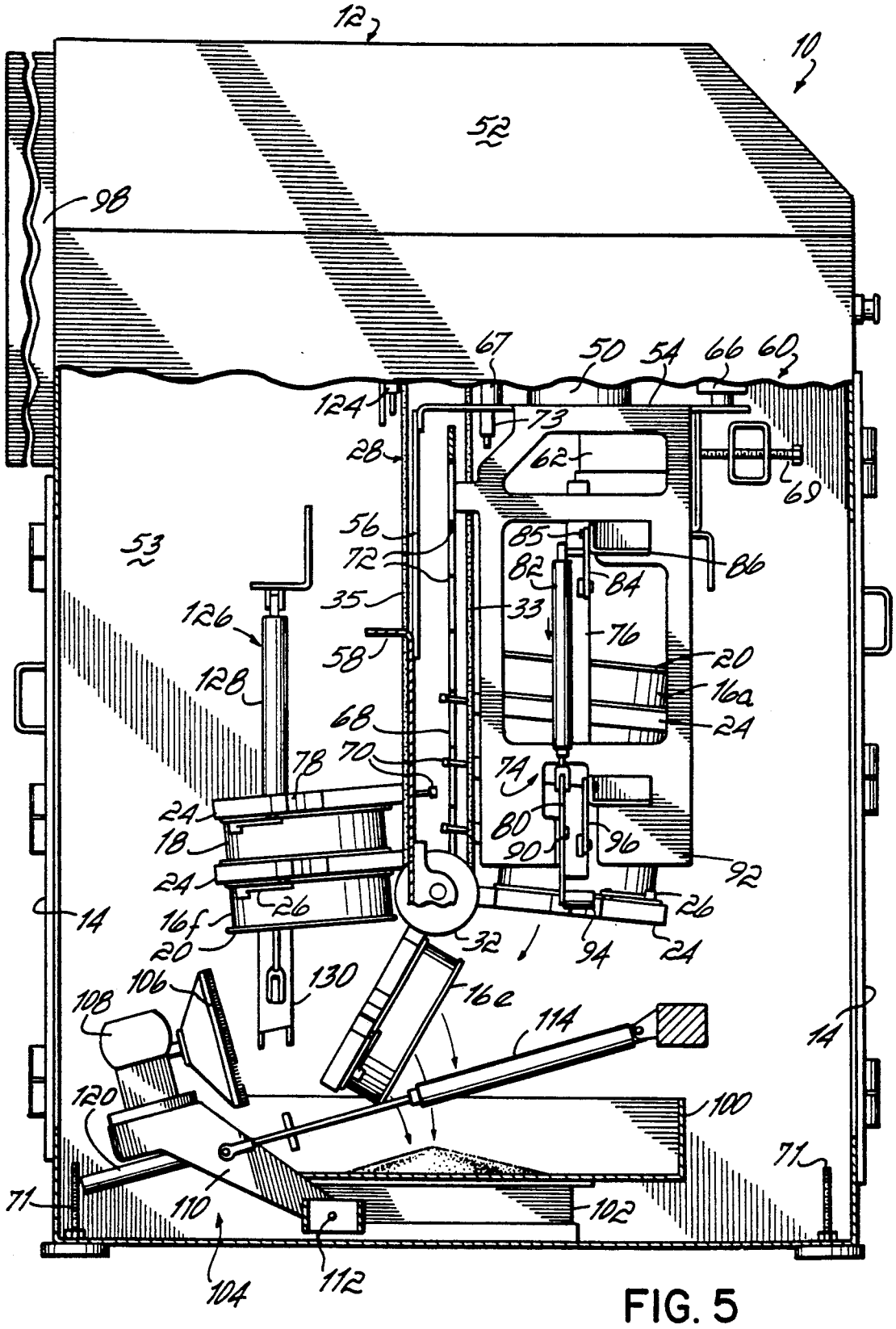
FIG. 5 is a vertical section similar to FIG. 4 but shows the relative positions of the sieves after two sieves have been emptied and a third is being emptied.
Figure 6:
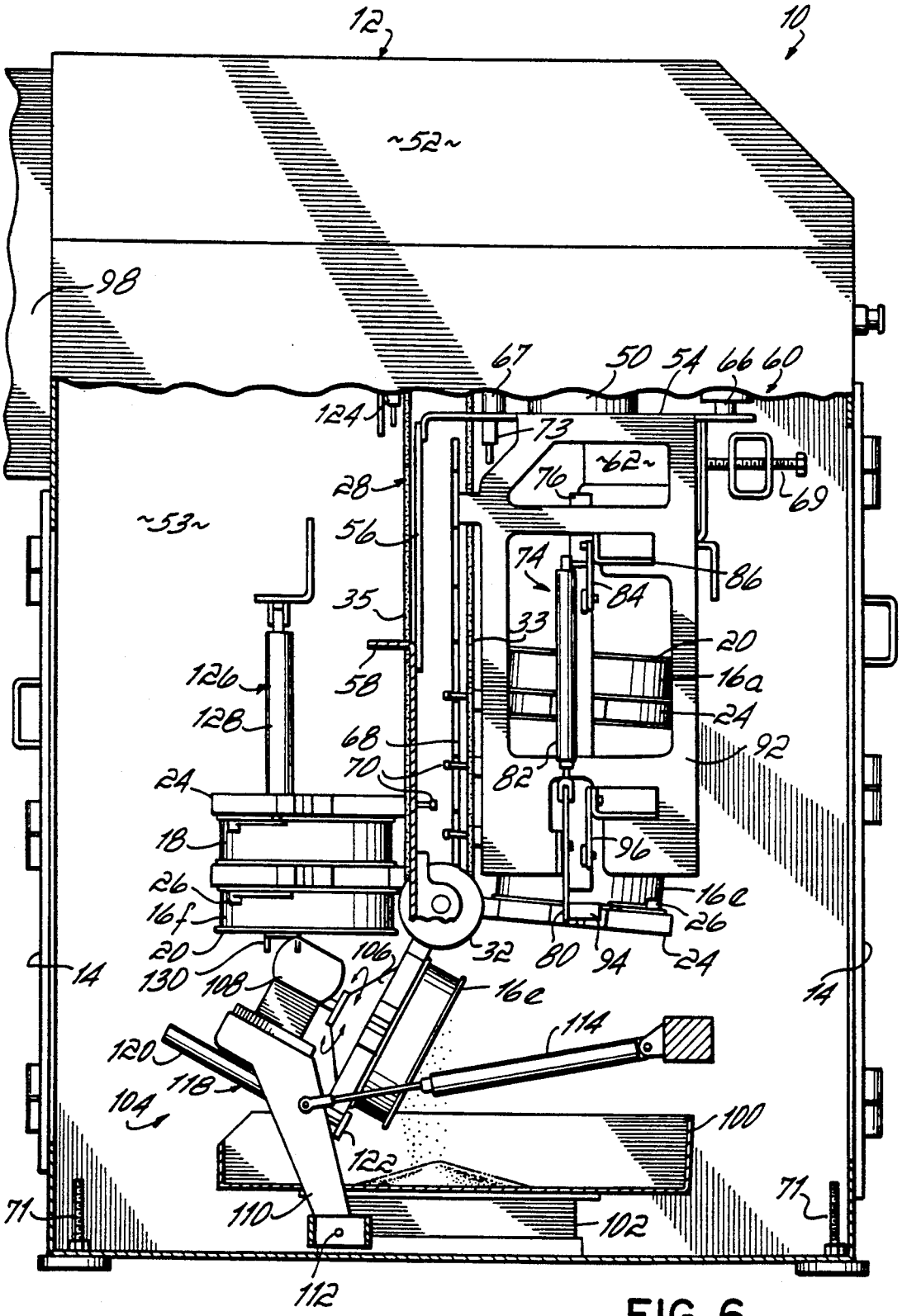
FIG. 6 is view similar to FIG. 5 but shows the sieve cleaner moved into position to engage and clean a sieve.

Because sieves 16*a–f* and 18 are individually cantilevered from conveyor 28 and are supported by it only at one side, they tend to sag downward under gravity if not further supported (note the tilt of the sieves on the right side of the conveyor in FIG. 6). Such sagging would be disadvantageous during shaking, because the central vertical axes of the individual sieves would be disaligned from one another and gaps could open between adjacent sieves and holders through which particles being screened could escape over the rims of the skirts 20. It has been found highly effective to provide means which position the sieves horizontally when they are to be shaken, and additionally to clamp them together in vertical alignment for shaking so that there is minimal or essentially no relative motion between the sieves during shaking. The sieves need not, however, be clamped together during the time that conveyor 28 is moving them, and they must of course be free to separate as they move about bottom roll 32. For this purpose there is provided a sieve holding back plate 68, shown in FIGS. 2, 3 and 4, which is mounted vertically from top plate 54 and which presents stop ledges that coact with a series of stop pins 70 on the respective sieve holders 24. Pins 70 extend from the sieve holders, through conveyor 28 (see FIG. 4) toward plate 68. The pins are simultaneously engageable against a series of sequentially offset stop ledges 72 in holding plate 68 as the sieves approach their topmost positions on vertical run 33. The stop ledges 72 are offset laterally like "stairs," along a side edge of plate 68 and are spaced apart vertically according to the distance between the respective pins 70 (see FIG. 3) so that as the conveyor moves upwardly, the pins engage the respective ledges. As conveyor 28 moves upwardly around rolls 30, 32 (counterclockwise as seen in FIG. 3) the stop pins, which project angularly upwardly by reason of the downward tilt of the respective holders, are moved upwardly with the conveyor. The pins essentially simultaneously engage the respective stop ledges, which arrests their further upward movement; short final upward travel of the conveyor thereby tilts the holders upwardly (counterclockwise in FIG. 5) from their sagged positions to the substantially horizontal positions shown in FIG. 4. Conveyor drive motor control means 98 or a limit safety switch 73 (FIG. 4), stops operation of motor 41 at the conveyor position at which the sieves are substantially horizontal. It is important that the sieves be level for shaking (for the same reason, cabinet 12 may have leveling screws 71 at its base to level the cabinet itself).

The sieves are then aligned laterally with one another and are clamped axially (vertically) for shaking. This alignment and clamping is preferably provided by double-functioning sieve aligning and clamping means, generally designated by 74, best shown in FIG. 7. The means 74 operates to press opposed V-sectioned lateral clamps 76, 76 diametrically toward the sieves, into engagement with corresponding V-shaped notches 78, 78 on opposite sides of the sieve holders 24. The clamps 76, 76 move toward one another in a vertical plane, generally parallel to the plane of vertical run 33, to cam the sieve holders laterally (horizontally) into alignment with one another.

As indicated above, the double-acting means 74 also clamps the sieves together vertically as well as aligning them horizontally. For this purpose the means 74 also operates diametrically opposed vertically swingable clamp arms 80, 80 to apply a lifting force to the bottom holder of the stack (see FIG. 7). When actuated, the vertical clamping arms 80 lift the entire stack of sieves upwardly until the top sieve 16*a* abuts and is clamped against the underside of top plate 54 which acts as a stop (see FIG. 7). Thus clamping means 74 constrains the stack of sieves both laterally and vertically.

The two sets of lateral and vertical clamp arms 76, 80 are preferably operated by double acting clamp cylinders 82, 82. At an upper end, each clamp cylinder 82 is pivotally connected to an upper clamp swing arm 84, which at an outer end is connected by a pivot 85 to a clamp means mounting bracket 86 carried from top plate 54 (see FIG. 2). The other end of upper clamp swing arm 84 is pivotally secured to lateral clamping arm 76. Cylinder 82 operates a piston rod 88, the lower end of which is connected to swing the vertical clamp arm 80 about its pivot 90 (see FIG. 7). Clamp arm 80 is pivoted to a bracket on side plate 92. Side plate 92 is connected to top plate 54, as is bracket 86. Extension of piston 88 from its cylinder 82 rotates clamp arm 80 about its pivot 90 and brings roller 94 into lifting engagement beneath the bottom holder 24 (see FIG. 7). It can be seen that in operation cylinder 82 both causes the lateral clamping arm 76 to be moved in a horizontal direction and the roller 94 to be moved upwardly. The mechanism operates both the lateral clamp arms and the vertical arms, moving each until stopping resistance is encountered. Control means 98 causes pressure fluid to be supplied to the clamp piston 82 when the sieves are at their upper positions and after they have been brought into horizontal position by engagement of their respective stop pins 70 with the stop ledges 72. Specifically, when fluid pressure (pneumatic pressure is preferred) is supplied into cylinder 82, piston rod 88 is extended, which swings both the upper clamp swing arm 84 and the vertical clamp arm 80 about their respective pivots. Referring to the right cylinder 82 in FIG. 7, its upper clamp swing arm 84 swings in a clockwise direction about its pivot 85, as indicated by the arrow 87, thereby moving lateral clamp arm 76 to the left, into the notches 78 of the sieve holders 24. At the same time, extension of piston 88 swings vertical clamping arm 80 clockwise about its pivot 90, bringing the roller 94 thereof upwardly against the bottom of the stack. To maintain parallelism and avoid cocking of the clamp arm 76, a lower clamping arm link 96 is pivotally connected between the lower end of lateral clamping arm 76 and a mounting bracket on side plate 92. The two arms 84, 96 establish a parallelogram-type movement which insures that clamp arm 76 remains vertical as it is moved laterally (FIG. 7). The sieves remain clamped only during the shaking cycle. (Because the clamping means is suspended from top plate 54, it moves with the sieves during the shaking cycle.)

The clamping means on the opposite side of the stack may be a mirror image of that just described and operates in a similar manner.

Sieve Emptying

At the completion of the shaking cycle, the control means 98 directs fluid pressure in the opposite direction to retract piston arms 88, and thereby essentially simultaneously disengages the lateral clamping arms and vertical clamping arms from the stack of sieves. Drive motor 40 is then energized to move the stack of sieves slowly downwardly toward lower roll 32. Movement is gradual, at a rate that does not throw particles off the respective sieves, for example 6.5 feet per per minute. As downward movement continues, bottom pan 18 is the first to move around roll 32. Because of the small diameter of roll 32 in relation to the larger size of the sieves, relatively short conveyor travel achieves a large angular swing of the respective sieve through an essentially vertical position, to an inverted or dump position such that the particles in that sieve fall out of it. By this means the sieve is inverted before the next sieve starts to empty (see FIG. 5). It is preferred that each sieve be stopped in a position in which it is angulated at about 120° to 140° with respect to its horizontal stacked position. Stopping is controlled by a switch 101 (FIG. 7), which de-energizes motor 40 when the sieve holder, at the dump position, engages the switch. The motor brake promptly stops and holds the belt with the sieve in the dump position. As it is inverted by movement around the bottom roll 32, each sieve dumps its contents into a weigh pan 100 (see FIG. 5). Weigh pan 100 rests on an electronic weigh scale 102 which provides a readout of the weight of particles discharged into it from each pan. Scales suitable for this purpose are commercially available, for example Toledo Scale Corporation Model SM 6000. The scale may reset or "zeroize" after recording the weight of the fraction; or preferably the computer 99 records the successively increasing weights in the pan and obtains the individual fraction weights by sequential subtraction, in known manner.

Pan 100 can be removed from scale 102 through door 14, for emptying. It is not necessary to empty the pan after each sieve has been dumped into it, or even after an entire sample analysis has been completed. An analysis usually requires samples of only a few hundred grams; pan 100 may be sized to hold many such samples.

The Sieve Cleaning Means

Although most of the particles retained on a sieve will fall from it as it is inverted, nevertheless some particles may adhere to or be lodged in its screen 22, especially particles whose size closely approximates the size of the mesh openings. For this purpose it is desirable to provide sieve cleaning means to brush or knock particles from each sieve (preferably including bottom pan 18) while it is inverted over the weigh pan 100 so that such particles can be included in the weight of the respective fraction.

The sieve cleaning means designated generally by 104 basically comprises a rotary brush 106 which is automatically moved from an inactive position shown in FIG. 5, into a cleaning position shown in FIGS. 6 and 8 in which the brush brushes the bottom (lower) side of the mesh of a sieve in the dump position. Brush 106 is dimensioned to engage substantially the entire area of mesh 22, to brush particles from the mesh so that they will fall into weigh pan 100 (see FIG. 8). Brush 106 is rotated by a brush drive motor 108, which is automatically energized at the appropriate time by control 98. The brush 106 is operated to brush the screen preferably by rotation in both directions; the cleaning means is removed to its inactive position before the conveyor is operated to move the just-cleaned sieve from the dump position and the next sieve into that position.

For movement of the brush and motor between the inactive position and the cleaning position, they are mounted on a cleaner swing arm 110 which is journaled to the cabinet base at pivot 112. The swing arm 110 is turned about pivot 112 by dual pneumatic cleaner positioning cylinders 114, one of which is shown in FIG. 5. When extended the piston of cylinder 114 positions the cleaning means in the inactive position; when retracted (FIG. 6) the piston swings arm 110 to bring brush 106 into approximate planarity with the mesh 22 of the sieve in the dump position. As shown in FIG. 8, brush 106 is yieldably mounted on motor shaft 115 and is biased outward (toward the sieve) by springs 116. Some movability of brush 106 on shaft 115 is provided by a pivot-in-slot connection 117. This provides a certain amount of yieldability and flexibility so that the brush will be brought more gently into contact and alignment with the screen 22.

I have found it desirable that each sieve be held rigidly while it is being cleaned so that it does not move away from the brush. For that purpose cleaner clamping means 118 is provided to engage the respective sieve holder 24 in the dump position and pull the holder and sieve in a direction toward the brush, as indicated by arrow 119 in FIG. 8. The cleaner clamping means has a clamp pad 122 which is operated by a pneumatic cylinder 120 mounted on and moved with arm 110. Clamp pad 122 is extended while the respective sieve is moving toward dump position so that holder 24 and its sieve will clear the extended clamp pad as the holder is swinging around roll 32. When retracted, pad 122 engages the edge of the holder (FIG. 8) and pulls the holder and sieve toward the brush for cleaning, against a stop 121 which is mounted by and moves with cleaner swinging arm 110. (It is not necessary to brush bottom pan 18 since it has no screen, but it is preferred that the brush at least strike the pan to knock loose any residual particles.)

Weighing of the fraction is delayed until the respective sieve has been cleaned so that the cleared particles will be included in the weight.

After cleaning, cleaning means 104 is retracted and conveyor 28 is operated to move the emptied sieve past the dump position and to advance the next sieve to that position. Just as the sieves tend to tilt downwardly on run 33, they again tend to tilt when they are on back run 35 after they have been emptied. The lowermost tilted sieve could interfere with movement of cleaning means 104. To provide clearance the inverted emptied sieves are lifted during cleaning by a back run sieve lifter 126 (FIGS. 2, 4, and 6). This comprises a pneumatic cylinder 128 which is swingably suspended in cabinet 12, and which operates a pivoted lifting arm 130 that is lifted to engage beneath the lowermost sieve on back run 35, to pull the sieves upward sufficiently for brush 106 to pass beneath them. The lifting movement is illustrated in FIGS. 2, 5 and 6.

The sequence of individual sieve emptying, cleaning, fraction weighing, and movement up back run 35 continues until the entire stack of sieves has been moved from the starting or shaking position shown in FIG. 4, in which all are on vertical run 33, to a finish position at which all have been emptied and are inverted on the back run 35. A safety switch 124 (FIG. 4) is desirable as a failsafe, to limit conveyor movement up the back run after all the sieves have been cleaned. Computer 99 (FIG. 1) is programmed to count the sieves as they are cleaned, and signals control 98 to reverse the motor after all have been cleaned, thereby to return the empty sieves to starting position. (The sieves need not be cleaned on the return.) Control 98 acts as a power relay, to control the application and cut-off of operating power to the various motors and solenoid operated valves. It is responsive to low power signals from computer 99 and the limit switches.

Having described the invention, what is claimed is:

1. A particle size analyzer comprising, a conveyor having a substantially vertical run, said conveyor being movable around a horizontal roll at the bottom of said vertical run, a set-of sieves of graduated mesh sizes, means individually mounting said sieves in mesh size order for movement with said conveyor around said roll, means for shaking said set of sieves to cause particles of different sizes, deposited on a topmost sieve of said set, to fall downwardly and be retained on the respective sieves according to particle size, drive means for moving said conveyor to advance said sieves around said roll, each sieve being inverted as it passes around said roll, thereby dumping particles on that sieve, and weighing means for receiving and weighing particles dumped from the respective sieves as said sieves are inverted by movement around said roll.

2. The particle size analyzer of claim 1 including control means which operates said shaking means only at a time when said sieves are positioned on said vertical run of said conveyor.

3. The particle size analyzer of claim 1 wherein said shaking means shakes said conveyor laterally.

4. The particle size analyzer of claim 1 wherein said shaking means includes an eccentric which shakes said sieves by moving them in elliptical paths.

5. The particle size analyzer of claim 1 wherein said shaking means includes a tapper which imparts repetitive blows to said set of sieves in a generally vertical direction.

6. The particle size analyzer of claim 1 further including control means for said conveyor drive means, said control means stopping movement of said conveyor when each respective sieve is at a position on said roll at which substantially all the particles retained on that sieve have fallen onto said weighing means.

7. The particle size analyzer of claim 6 wherein said control means reverses said drive means to return said sieves to a starting position on said run after all the sieves of said set have been so inverted.

8. The particle size analyzer of claim 1 wherein said conveyor moves said sieves vertically downward on said run to said roll.

9. The particle size analyzer of claim 1 wherein said conveyor has a substantially vertical back run.

10. The particle size analyzer of claim 1 wherein the mounting means positions said sieves together as a stack on said run above said roll.

11. The particle size analyzer of claim 10 further including selectively operable clamping means for clamping the set of sieves together for shaking thereof.

12. The particle size analyzer of claim 11 wherein said clamping means comprises movable clamp arms, and clamp arm actuating means for moving said clamp arms into engagement with sieves to align said sieves laterally and clamp them together vertically for shaking.

13. The particle size analyzer of claim 1 further including sieve cleaning means for dislodging particles remaining on each said sieve while said sieve is inverted over said weighing means.

14. The particle size analyzer of claim 13 further including means comprises means for moving said cleaning means from an inactive position spaced from said conveyor, into cleaning engagement with each respective sieve after such sieve has been inverted and substantially emptied.

15. The particle size analyzer of claim 13 wherein said cleaning means moves a brush in a rotary path of movement on each said sieve.

16. The particle size analyzer of claim 1 wherein said conveyor comprises an endless belt.

17. The particle size analyzer of claim 1 including spring means for maintaining tension on said conveyor.

18. The particle size analyzer of claim 1 wherein each said sieve is cantilevered to said conveyor by said mounting means.

19. The particle size analyzer of claim 1 wherein said mounting means comprises a bracket mounted to said conveyor, said bracket projecting outwardly from said conveyor, and means for securing a sieve onto said bracket.

20. The particle size analyzer of claim 1 including shaking control means for operating said shaking means only while said sieves are all above said roll on said run.

21. The particle size analyzer of claim 1, further comprising means/holding said sieves together as a stack during said shaking.

22. The particle size analyzer of claim 1, further including belt tensioning spring means for applying tension to said belt thereby to hold said sieves more nearly perpendicular to said conveyor on said run.

23. The particle size analyzer of claim 1 further including means for bringing said sieves to a horizontal position preparatory to said shaking.

24. An automatic particle size analyzer comprising, a series of sieves of graduated sizes, mounting means connecting said sieves together as a stack in size sequence, said mounting means permitting movement of the sieves relative to one another while maintaining said sequence, means for shaking said sieves as a substantially vertical stack, to sort particles thereon according to size range, weighing means for weighing particles placed thereon, moving means for separating a sieve from said stack while leaving the other sieves in substantially vertical position so that the sorted particles remain on the respective other sieves, tipping such separated sieve to dump particles from it onto said weighing means, and returning the sieve to said stack after emptying.

25. The automatic particle size analyzer of claim 24 wherein said moving means so separates and tips the sieves of said stack in sequence from finest size to coarsest size.

26. An automatic particle size analyzer comprising, a series of sieves of graduated sizes, mounting means connecting said sieves together as a stack in size sequence, said mounting means permitting movement of the sieves relative to one another while maintaining said sequence, said mounting means comprising a vertical conveyor onto which said sieves are mounted and an end roll around which said conveyor moves downwardly, means for shaking said sieves as a stack, to sort particles thereon according to size range, weighing means for weighing particles placed thereon, moving means for separating a sieve from said stack, tipping such sieve to dump particles from it onto said weighing means, and returning the sieve to said stack after emptying, said moving means comprising a conveyor drive, movement of said conveyor around said end roll sequentially separating each sieve from the stack and inverting it to empty the particles on each respective sieve onto said weighing means, and returning the sieve to the stack in inverted order.

27. The automatic particle size analyzer of claim 26 wherein said end roll is dimensioned so that each sieve is inverted and emptied before another sieve is inverted.

28. Apparatus comprising a sieve conveyor having a vertical run and movable around an end roll at a lower end of said vertical run, a series of sieves extending outwardly from said conveyor but sagging downwardly under gravity when on said vertical run of said conveyor, and leveling means for bringing the respective sieves into substantially horizontal attitudes when at predetermined positions on said vertical run, said leveling means comprising, each sieve having a pin extending laterally from it, and stop means arresting upward travel of the respective pins as the sieves approach the said predetermined positions, continued upward movement of the conveyor after the pins have been arrested, tipping the pins and thereby tipping the sieves into said substantially horizontal attitudes at said predetermined positions.

29. The apparatus of claim 28 wherein each said sieve is mounted to a sieve holder, said holders are secured to said conveyor, and said pins project from said holders.

30. The apparatus of claim 28 wherein said conveyor is an endless belt, and said sieves extend outwardly from said belt.

31. The apparatus of claim 30 wherein said pins project through said belt, oppositely from said sieves.

32. The apparatus of claim 28 wherein said stop means is a fixed plate having a series of horizontal ledges engageable by the respective pins.

33. The apparatus of claim 28 wherein the pins of the respective sieves are laterally offset and move along laterally spaced paths of travel, and wherein said stop means includes correspondingly offset stops to engage the respective pins on said paths of travel.

34. Apparatus comprising, a sieve conveyor having a vertical run, said conveyor being movable around a horizontal roll at a lower end of said vertical run, a series of graduated stackable sieves extending outwardly from said conveyor, and means for aligning and clamping said sieves together on said vertical run as a stack, comprising, at least one laterally movable clamp movable toward said sieves on said vertical run, and engageable with them to cam them into vertical alignment, and at least one vertically movable clamp engageable with a lowermost sieve of said set to clamp said set upwardly against a stop.

35. The apparatus of claim 34 further including means for operating said laterally movable clamp to align the sieves laterally, and operating the vertically movable clamp to clamp the sieves together.

36. The apparatus of claim 34 further wherein both said laterally movable clamp and said vertically movable clamp are operated by a common cylinder.

37. The apparatus of claim 34 including two such laterally movable clamps, said laterally movable clamps being positioned on opposite sides of said sieves, and being movable toward one another to engage said sieves between them.

38. The apparatus of claim 37 wherein each said sieve is mounted on a sieve holder having a camming surface, and wherein said laterally movable clamps engage said camming surfaces and cam said holders into alignment.

39. The apparatus of claim 34 including a pair of diametrically opposed clamps on opposite sides of said sieves.

40. The apparatus of claim 34 wherein said vertically movable clamp clamps said set by lifting said clamps upwardly against a stop.

41. Apparatus comprising, a series of graduated sieves, a sieve conveyor having a vertical run, said conveyor movable around a horizontal roll at a lower end of said vertical run, said series of sieves individually mounted to said conveyor for movement with it around said roll, movement of the conveyor inverting each sieve as it passes around said roll and dumping particles on that sieve, sieve cleaning means for dislodging any particles remaining on the respective sieve after such inversion, said sieve cleaning means engaging the respective sieve while so inverted, and cleaner moving means for moving said sieve cleaning means between an inactive position, in which the cleaning means is removed from the sieves as they travel around said roll, and a cleaning position in which the cleaning means engages a bottom surface of the respective sieve while that sieve is inverted.

42. The apparatus of claim 41 further including control means for stopping said conveyor at a position where a sieve, moving around said roll, has dumped most of the particles therein, said control means operating said cleaner moving means from said inactive position to said cleaning position, operating said cleaning means, and returning said cleaning means to said inactive position while the respective sieve is stopped.

43. The apparatus of claim 41 wherein said sieve cleaning means comprises a brush and a brush drive, and said cleaner moving means comprises a swing arm on which said brush and brush drive are mounted.

44. The apparatus of claim 41 wherein said sieves are circular, and said cleaning means comprises a brush which is rotated against the respective sieve.

45. The apparatus of claim 41 further including means for holding the respective sieve against movement while it is being cleaned.

46. The apparatus of claim 45 wherein the holding means comprises a piston arm which holds the sieve against a stop.

47. The apparatus of claim 46 wherein said piston arm pulls the respective sieve toward said stop.

48. The apparatus of claim 46 wherein said piston and stop are mounted to said cleaner moving means.

49. Apparatus comprising, a set of stackable, graduated sieves, a sieve conveyor having a vertical run, said sieves mounted to and projecting angularly outwardly from said conveyor, said sieves arranged in order of progressively finer mesh size in the downward direction on said vertical run, interfitting as a stack on said vertical run, and means for moving said conveyor around an end roll, thereby to invert the lines in sequence.

* * * * *